US007100255B1

(12) United States Patent
McNamee et al.

(10) Patent No.: US 7,100,255 B1
(45) Date of Patent: Sep. 5, 2006

(54) APPARATUS FOR REMOVING DOOR HINGE PINS

(75) Inventors: James McNamee, Woodburn, OR (US); Lloyd Breiland, Woodburn, OR (US)

(73) Assignee: Bang It LLC, Woodburn, OR (US)

( * ) Notice: Subject to any disclaimer, the term of this patent is extended or adjusted under 35 U.S.C. 154(b) by 0 days.

(21) Appl. No.: 11/341,776

(22) Filed: Jan. 26, 2006

Related U.S. Application Data

(60) Provisional application No. 60/647,503, filed on Jan. 27, 2005.

(51) Int. Cl.
*B25B 27/14* (2006.01)

(52) U.S. Cl. ..... 29/275; 29/278

(58) Field of Classification Search ..... 29/275, 29/278, 280–283, 244, 281.1
See application file for complete search history.

(56) References Cited

U.S. PATENT DOCUMENTS

| | | | | |
|---|---|---|---|---|
| 4,183,133 | A | 1/1980 | Abbott | |
| 5,303,619 | A * | 4/1994 | Cole, Sr. | 81/180.1 |
| 5,875,535 | A | 3/1999 | Canoy | |
| 6,308,390 | B1 * | 10/2001 | Sullivan | 29/275 |
| 6,351,881 | B1 | 3/2002 | Peckich et al. | |
| 6,684,471 | B1 | 2/2004 | Jones | |
| 6,957,477 | B1 * | 10/2005 | Neiman | 29/278 |
| 7,047,610 | B1 * | 5/2006 | Dawson | 29/281.1 |
| 2006/0123611 | A1 * | 6/2006 | Wood | 29/275 |

* cited by examiner

*Primary Examiner*—Lee D. Wilson
(74) *Attorney, Agent, or Firm*—Blakely, Sokoloff, Taylor & Zafman LLP

(57) ABSTRACT

An apparatus for removing a door hinge pin from a door hinge is described. The apparatus comprises a base, an elongated guiding member connected to the base, and a rod that is also connected to the base. The guiding member has a longitudinal depression defining a channel that extends from a first end of the guiding member to a second end. The rod is connected to the base at a location that is substantially external to the channel.

6 Claims, 1 Drawing Sheet

APPARATUS FOR REMOVING DOOR HINGE PINS

RELATED APPLICATIONS

The present application claims the benefit of priority under 35 U.S.C. § 119(e) to U.S. Provision Application No. 60/647,503, filed Jan. 27, 2005.

FIELD

Embodiments of the invention relate to hand tools, and more particularly to tools used in removing hinge pins from doors.

BACKGROUND

Door hinge pins are normally inserted downward through the topside of a door hinge pin slot of a door hinge. While the location or placement of the pin makes it easy to install, the door hinge pin is often difficult to remove. A common technique for removing a door hinge pin is to hold a nail to the hinge pin slot on the bottom side of the door hinge and then hit the nail with a hammer to knock the hinge pin out of the hinge. This hammer-and-nail technique has several drawbacks.

One drawback is that it can be very difficult to position a nail under the hinge given that the size of the hinge pin slot is small and that there is little room for error in placement. When the door hinge is low to the ground, the bottom side of the hinge cannot be seen without crouching down on the floor, making the task more difficult. A traditional approach for guiding a nail or other object into the hinge pin slot involves guiding the hinge pin by sight and/or feeling with the use of fingers, which can be awkward and/or challenging.

Another drawback to the hammer-and-nail technique is that it is easy to hit a thumb or a finger with the hammer while awkwardly holding a nail to the hinge pin slot. It is also easy to miss the nail and strike the molding around the doorframe, or even strike the door itself, potentially causing damage to the door. Other prior art tools and techniques have similar drawbacks.

BRIEF DESCRIPTION OF THE DRAWINGS

The following description includes discussion of various figures having illustrations given by way of example of implementations of embodiments of the invention. The drawings should be understood by way of example, and not by way of limitation.

SUMMARY OF THE INVENTION

Figure 1:
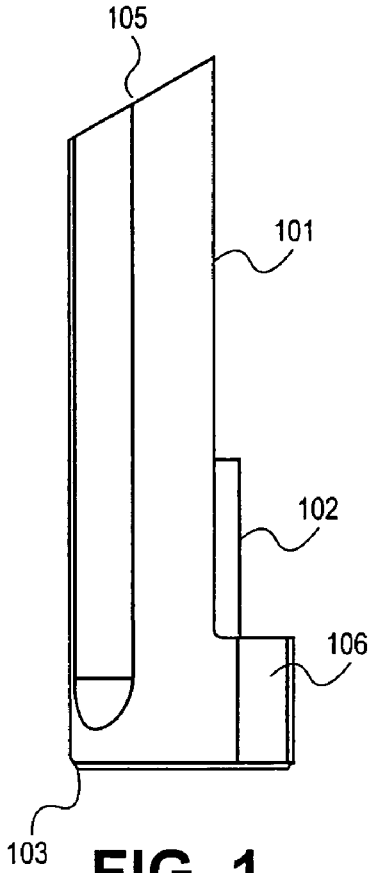
FIG. 1 is an illustration of an embodiment of the invention from a first perspective.

A door hinge pin removal tool is used to remove a hinge pin from a door hinge. The hinge pin removal tool has a base, a guiding member connected to the base, and a removal rod that is also connected to the base. The guiding member includes a longitudinal depression that defines a channel that extends from a first end of the guiding member to the second end of the guiding member. The removal rod is connected to the base at a location that is substantially external to the channel defined by the longitudinal depression of the guiding member.

A user can remove a hinge pin from a door hinge by bringing the hinge pin removal tool towards the hinge and allowing the guiding member to make contact with the hinge. Once the guiding member makes contact with the hinge, the guiding member helps guide the removal rod towards the hinge pin slot on the bottom of the hinge. When the tool is in place such that the removal pin is lined up with the hinge pin slot, a blow from a hammer or other blunt object to the base of the tool knocks the hinge pin loose from the hinge.

DETAILED DESCRIPTION

As used herein, references to one or more "embodiments" are to be understood as describing a particular feature, structure, or characteristic included in at least one implementation of the invention. Thus, phrases such as "in one embodiment" or "in an alternate embodiment" appearing herein describe various embodiments and implementations of the invention, and do not necessarily all refer to the same embodiment. However, they are also not necessarily mutually exclusive. Descriptions of certain details and implementations follow, including a description of the figures, which may depict some or all of the embodiments described below, as well as discussing other potential embodiments or implementations of the inventive concepts presented herein. An overview of embodiments of the invention is provided below, followed by a more detailed description with reference to the drawings.

FIGS. 1–4 illustrate an embodiment of the invention. The invention is a door hinge pin removal tool. The tool has a base 103, a guiding member 101, and a removal rod 102. In one embodiment, the guiding member 101 includes a longitudinal depression that defines a channel 106 extending from a first end (the end connected to the base 103) to a second end 105. Removal rod 102 is connected/affixed to base 103 at a location that is substantially external to the channel 106 defined by the longitudinal depression of the guiding member 101. In other words, the removal rod 102 is not enclosed or substantially surrounded by the guiding member 101.

In one embodiment, the body of the tool, including base 103 and guiding member 101, is made of plastic. In another embodiment, the tool is made of wood. Other materials commonly used/known in the art may also be used. The size of channel 106 is such that the tool fits against a door hinge. In one embodiment, the tool is 4 inches long and ⅝ inches in diameter. However, one of ordinary skill in the art will appreciate that the tool can be constructed having any range of dimensions suitable for use with a door hinge. In the embodiment illustrated in FIGS. 1–4, the shape of the tool is roughly cylindrical, which can be seen by observing the mostly-circular shape of base 103. However, the invention is not limited to cylindrical shapes. In other embodiments, base 103 can be square, rectangular, triangular, etc.

In one embodiment, removal rod 102 is composed of metal or other metallic substance. In other embodiments, the removal rod 102 is composed of plastic, wood, or other substance commonly known/used in the art. The material used for the removal rod is not critical to the invention.

Figure 2:
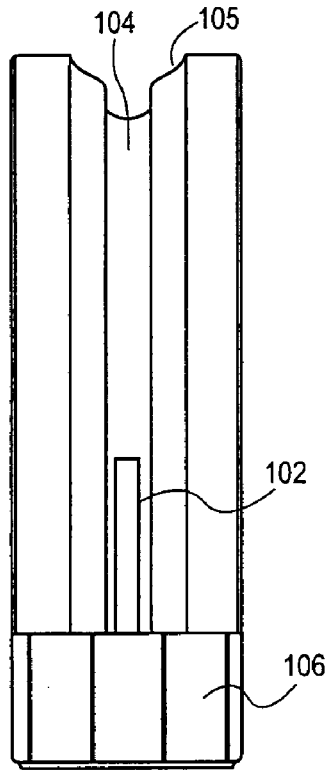
FIG. 2 is an illustration of an embodiment of the invention from a second perspective.
Figure 3:
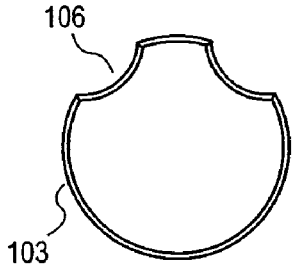
FIG. 3 is an illustration of an embodiment of the invention from a third perspective.
Figure 4:
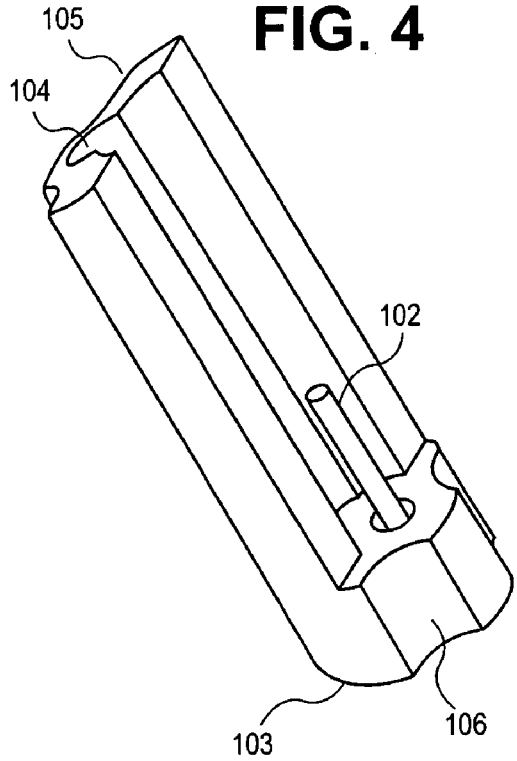
FIG. 4 is an illustration of an embodiment of the invention from a fourth perspective.

Guiding member 101 is used to guide removal rod 102 into the door hinge pin slot of a door hinge. As shown in FIG. 2 and FIG. 4, guiding member 101 includes a longitudinal depression that defines a channel 106 extending from base 103 (the first end) to the second end 105 of the guiding member 101. The channel 106 allows the guiding member to fit partially around a door hinge to facilitate the guiding of the removal rod into the door hinge pin slot. When guiding member 101 is placed against the door hinge, the removal rod 102 lines up axially with the door hinge pin slot. Thus, a user may slide the tool along the door hinge until the removal rod 102 makes contact with the door hinge pin. In one embodiment, an additional channel or groove 104 is added to the guiding member 101 to create edges or tracks within the longitudinal depression that further assist in the guiding of the removal rod directly into the door hinge pin slot, where it subsequently makes contact with the door hinge pin.

Base 103 is designed to receive blows from a hammer or other blunt object. When the removal rod 102 is in contact with the door hinge pin, a blow to the base 103 will cause the door hinge pin to be knocked loose from the hinge.

In the process of knocking the door hinge pin loose, the door hinge pin is often not knocked completely out of the door hinge pin slot. As shown in FIG. 1, the second end 105 of guiding member 101 is angled as opposed to being parallel with the base 103. This angling allows the user to insert or wedge the second end 105 of the guiding member under the head of the door hinge pin to lift the door hinge pin completely out of the door hinge pin slot. If necessary, the base 103 can be struck or tapped to facilitate lifting the pin out of the hinge pin slot.

What is claimed is:

1. An apparatus for removing door hinge pins from door hinges, comprising:

a base;

an elongated guiding member having a first end connected to the base, a second end, and a longitudinal depression forming a channel extending from the first end to the second end; and a rod having a first end connected to the base at a location that is substantially external to the channel defined by the longitudinal depression of the guiding member.

2. The apparatus of claim 1, wherein the length of the rod is substantially shorter than the length of the guiding member.

3. The apparatus of claim 1, wherein the rod is lengthwise parallel to the guiding member.

4. The apparatus of claim 1, wherein the longitudinal depression comprises longitudinal grooved edges that extend from the first end of the guiding member to the second end of the guiding member to facilitate guiding the pin into a door hinge pin slot.

5. The apparatus of claim 1, wherein the second end of the guiding member is angled to allow the second end to be wedged under the head of a door hinge pin to facilitate removal of the door hinge pin from a door hinge.

6. The apparatus of claim 1, wherein the location of the removal rod on the base is completely external to the channel defined by the longitudinal depression of the guiding member.

* * * * *